US009858742B2

(12) United States Patent
Kim

(10) Patent No.: US 9,858,742 B2
(45) Date of Patent: Jan. 2, 2018

(54) ULTRASONIC SENSOR FOR DETECTING DOUBLE SHEETS AND METHOD OF DETECTING DOUBLE SHEETS USING THE SAME

(71) Applicant: Nautilus Hyosung Inc., Seoul (KR)

(72) Inventor: Young Bae Kim, Yongin-si (KR)

(73) Assignee: Nautilus Hyosung Inc., Seoul (KR)

( * ) Notice: Subject to any disclaimer, the term of this patent is extended or adjusted under 35 U.S.C. 154(b) by 218 days.

(21) Appl. No.: 14/581,697

(22) Filed: Dec. 23, 2014

(65) Prior Publication Data

US 2015/0235500 A1 Aug. 20, 2015

(30) Foreign Application Priority Data

Feb. 18, 2014 (KR) ..... 10-2014-0018320

(51) Int. Cl.

| | |
|---|---|
| ***G07D 7/08*** | (2006.01) |
| ***G07D 7/16*** | (2016.01) |
| ***G07D 7/183*** | (2016.01) |

(52) U.S. Cl.

CPC ..... *G07D 7/166* (2013.01); *G07D 7/08* (2013.01); *G07D 7/183* (2017.05)

(58) Field of Classification Search

CPC ..... G07D 7/166; G07D 7/08

USPC ..... 367/137

See application file for complete search history.

(56) References Cited

U.S. PATENT DOCUMENTS

| | | | | |
|---|---|---|---|---|
| 2,931,978 A * | 4/1960 | Erdman | G01N 29/348 | 324/76.41 |
| 3,145,363 A * | 8/1964 | Haslett | G01S 15/04 | 367/108 |
| 3,688,565 A * | 9/1972 | Brech | G01B 17/02 | 73/609 |
| 4,361,042 A * | 11/1982 | Takahashi | G01N 29/0663 | 73/603 |
| 6,988,026 B2 * | 1/2006 | Breed | G07C 5/0808 | 701/31.4 |
| 8,534,667 B2 * | 9/2013 | Cha | B65H 5/062 | 271/228 |

(Continued)

FOREIGN PATENT DOCUMENTS

| | | |
|---|---|---|
| JP | 2004-231404 A | 8/2004 |
| KR | 10-2006-0108399 A | 10/2006 |

(Continued)

*Primary Examiner* — Luke Ratcliffe
*Assistant Examiner* — Amie M N'Dure
(74) *Attorney, Agent, or Firm* — Fenwick & West LLP

(57) ABSTRACT

The present invention relates to an ultrasonic sensor for detecting double sheets and a method of detecting double sheets using the same, in which in configuring the ultrasonic sensor for detecting double sheets of banknotes passing through a transfer path, the ultrasonic sensor is configured to include an ultrasonic wave generator and an ultrasonic wave receiver provided in pair to face each other in a direction perpendicular to a transfer direction of the banknotes with the transfer path for transferring the banknotes interposed therebetween, and periodicity of a reception signal detected by the ultrasonic wave receiver is determined to detect whether a zero sheet, a single sheet or double sheets of the banknotes pass through the transfer path according to generation or not of the periodic signal and/or a frequency of the generation.

3 Claims, 3 Drawing Sheets

(56) References Cited

U.S. PATENT DOCUMENTS

| | | | | |
|---|---|---|---|---|
| 8,931,777 | B2 * | 1/2015 | Okitsu | B65H 7/125 271/262 |
| 9,342,942 | B2 * | 5/2016 | Yoon | G07D 11/006 |
| 2003/0193273 | A1 * | 10/2003 | Yamashita | G07D 11/0081 312/100 |
| 2008/0210605 | A1 * | 9/2008 | Park | B07C 5/34 209/534 |
| 2009/0134222 | A1 * | 5/2009 | Ikeda | G06K 7/084 235/440 |
| 2009/0218752 | A1 * | 9/2009 | Kobayashi | B65H 1/24 271/10.09 |
| 2009/0260440 | A1 * | 10/2009 | Pellaton | G01N 29/11 73/600 |
| 2009/0274501 | A1 * | 11/2009 | Enzien | G03G 21/046 399/366 |
| 2013/0020172 | A1 * | 1/2013 | Cha | G07D 11/0081 194/206 |
| 2013/0026004 | A1 * | 1/2013 | Cha | B65H 9/166 198/416 |
| 2013/0332780 | A1 * | 12/2013 | Hikichi | G06F 11/004 714/47.3 |
| 2014/0091516 | A1 * | 4/2014 | Okitsu | B65H 7/125 271/262 |

FOREIGN PATENT DOCUMENTS

| | | | |
|---|---|---|---|
| KR | 10-2010-0060996 | A | 6/2010 |
| KR | 10-1181434 | B1 * | 9/2012 |
| KR | 101181434 | B1 * | 9/2012 |

* cited by examiner

ULTRASONIC SENSOR FOR DETECTING DOUBLE SHEETS AND METHOD OF DETECTING DOUBLE SHEETS USING THE SAME

CROSS-REFERENCE TO RELATED APPLICATION

This application claims priority under 35 U.S.C. §119(a) to Korean Patent Application No. 10-2014-0018320 filed on Feb. 18, 2014, which is incorporated by reference herein in its entirety.

BACKGROUND OF THE INVENTION

1. Field of Invention

The present invention relates to an ultrasonic sensor for detecting double sheets and a method of detecting double sheets using the same. More particularly, the present invention relates to an ultrasonic sensor for detecting double sheets and a method of detecting double sheets using the same, in which in configuring the ultrasonic sensor for detecting double sheets of banknotes passing through a transfer path, the ultrasonic sensor is configured to include an ultrasonic wave generator and an ultrasonic wave receiver provided in pair to face each other in a direction perpendicular to a transfer direction of the banknotes with the transfer path for transferring the banknotes interposed therebetween, and periodicity of a reception signal detected by the ultrasonic wave receiver is determined to detect whether a zero sheet, a single sheet or double sheets of the banknotes pass through the transfer path according to generation or not of the periodic signal and/or a frequency of the generation, whereby utilization of space of an automatic teller machine can be enhanced by reducing volume of the apparatus through the vertical arrangement of the ultrasonic wave generator and the ultrasonic wave receiver, and, at the same time, double sheets of the banknotes can be detected by effectively detecting the number of sheets of banknotes, and efficiency of processing the banknotes can be enhanced.

2. Description of the Related Art

Generally, in an automatic teller machine, an apparatus for detecting double sheets of banknotes is provided on a transfer path for transferring the banknotes and detects whether or not the banknotes transferred one by one along the transfer path are overlapped with each other and transferred in double sheets.

At this point, an ultrasonic sensor is chiefly used in the apparatus for detecting double sheets of banknotes described above. In configuring such an ultrasonic sensor for detecting double sheets, generally, an ultrasonic wave generator and an ultrasonic wave receiver are provided over and under the transfer path, respectively, so that the ultrasonic wave generated by the ultrasonic wave generator passes through the transfer path and is then detected by the ultrasonic wave receiver to detect double sheets of the banknotes passing through the transfer path.

However, as described above, when double sheets of banknotes passing through the transfer path are detected using the ultrasonic sensor, there is a problem in that a reflective wave reflected by the banknotes transferred between the ultrasonic wave generator and the ultrasonic wave receiver or reflected by the ultrasonic wave generator and the ultrasonic wave receiver enters the ultrasonic wave receiver and thus a reception signal is distorted. Therefore, in configuring an ultrasonic sensor for detecting double sheets in an automatic teller machine, as shown in Korean Patent No. 10-1276492 (issue date: Jun. 12, 2013) entitled "Bill detecting apparatus using ultrasonic sensor and detecting method thereof," an ultrasonic wave generator 10 and an ultrasonic wave receiver 20 are provided over and under a transfer path through which a banknote 11 passes, respectively, in which the ultrasonic wave generator 10 and the ultrasonic wave receiver 20 are provided to face each other in a diagonal direction with respect to the transfer path so that the effect of the reflective wave can be minimized by allowing an ultrasonic wave transmitted from the ultrasonic wave generator 10 to be received by the ultrasonic wave receiver 20 in the diagonal direction at a predetermined slope.

However, since in the above-described conventional ultrasonic sensor, as shown in FIG. 1, the ultrasonic wave generator and the ultrasonic wave receiver are respectively arranged over and under the transfer path to face each other in a diagonal direction at a predetermined slope with respect to the transfer path, the installation space of the ultrasonic wave generator and the ultrasonic wave receiver is expanded and thus overall volume of the apparatus increases, thereby lowering utilization of the space.

SUMMARY OF THE INVENTION

The present invention is conceived to solve the problem according to the conventional technique described above. That is, an object of the present invention is to provide an ultrasonic sensor for detecting double sheets and a method of detecting double sheets using the same, in which in configuring the ultrasonic sensor for detecting double sheets of banknotes passing through a transfer path, the ultrasonic sensor is configured to include an ultrasonic wave generator and an ultrasonic wave receiver provided in pair to face each other in a direction perpendicular to a transfer direction of the banknotes with the transfer path for transferring the banknotes interposed therebetween, and periodicity of a reception signal detected by the ultrasonic wave receiver is determined to detect whether a zero sheet, a single sheet or double sheets of the banknotes pass through the transfer path according to generation or not of the periodic signal and/or a frequency of the generation, whereby utilization of space of an automatic teller machine can be enhanced by reducing volume of the apparatus through the vertical arrangement of the ultrasonic wave generator and the ultrasonic wave receiver, and, at the same time, double sheets of the banknotes can be detected by effectively detecting the number of sheets of banknotes, and efficiency of processing the banknotes can be enhanced.

According to an aspect of the present invention for achieving the objects, there is provided an ultrasonic sensor for detecting double sheets of banknotes passing through a transfer path, including an ultrasonic wave generator and an ultrasonic wave receiver provided in pair to face each other in a direction perpendicular to a transfer direction of the banknotes with the transfer path for transferring the banknotes interposed therebetween, wherein periodicity of a reception signal detected by the ultrasonic wave receiver is determined, and whether a zero sheet, a single sheet, or double sheets of the banknotes pass through the transfer path is detected according to generation or not of the periodic signal and/or a frequency of the generation.

In accordance with the ultrasonic sensor for detecting double sheets of the present invention and a method of detecting double sheets using the same, in configuring an ultrasonic sensor for detecting double sheets of banknotes passing through a transfer path, the ultrasonic sensor includes an ultrasonic wave generator and an ultrasonic wave receiver provided in pair to face each other in a direction perpendicular to a transfer direction of the banknotes with the transfer path for transferring the banknotes interposed therebetween, and periodicity of a reception signal detected by the ultrasonic wave receiver is determined to detect whether a zero sheet, a single sheet or double sheets of the banknotes pass through the transfer path according to generation or not of the periodic signal and/or a frequency of the generation. Thus, it is possible to enhance utilization of space of an automatic teller machine by reducing the volume of the apparatus through the vertical arrangement of the ultrasonic wave generator and the ultrasonic wave receiver.

In addition, in accordance with the present invention, it is possible to detect double sheets of banknotes further effectively by correctly detecting the number of sheets of banknotes and to enhance efficiency of processing the banknotes.

DETAILED DESCRIPTION OF THE PREFERRED EMBODIMENT

Hereinafter, preferred embodiments of the present invention will be described in detail with reference to the accompanying drawings.

Figure 1:
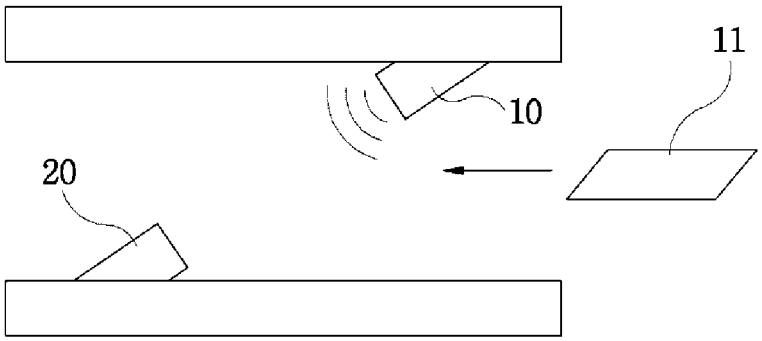
FIG. 1 is a view showing a structure in which an ultrasonic wave generator and an ultrasonic wave receiver are diagonally arranged in accordance with the prior art.
Figure 2:
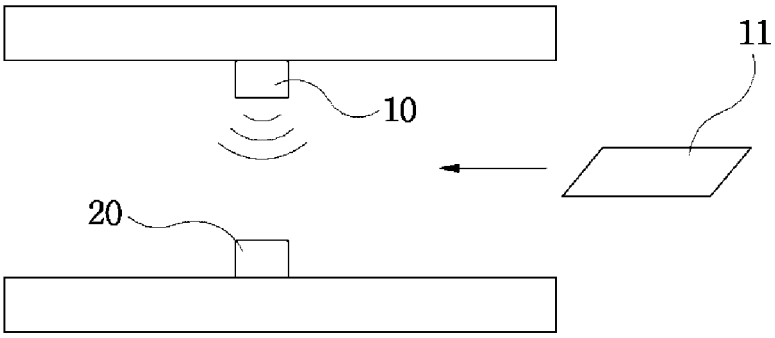
PRIOR ART Fig.2
FIG. 2 is a view showing a structure in which an ultrasonic wave generator and an ultrasonic wave receiver are vertically arranged in accordance with the present invention.

FIG. 2 is a view showing a vertical arrangement structure of an ultrasonic sensor for detecting double sheets in accordance with the present invention.

As shown in FIG. 2, first, an ultrasonic sensor in accordance with the present invention is based on a configuration in which an ultrasonic wave generator 10 and an ultrasonic wave receiver 20 are provided to face each other in a direction perpendicular to a transfer direction of a banknote 11 with a transfer path interposed therebetween. If the banknote 11 is detected to be input, an ultrasonic wave is transmitted from the ultrasonic wave generator 10 and the banknote is irradiated with the ultrasonic wave. Then, the ultrasonic wave receiver 20 receives the ultrasonic wave penetrating the banknote, and the ultrasonic sensor detects the reception signal.

Figure 3A:
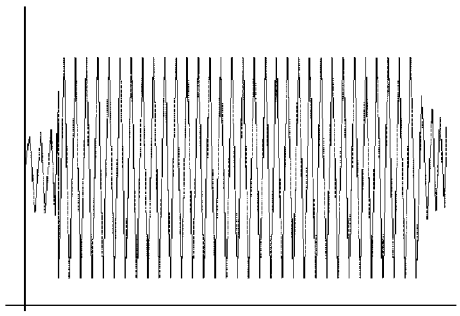
FIGS. 3A through 3D are diagrams showing waveforms of a signal received at the ultrasonic wave receiver according to the number of sheets of banknotes passing through a transfer path in an ultrasonic sensor in accordance with the present invention.
Figure 3B:
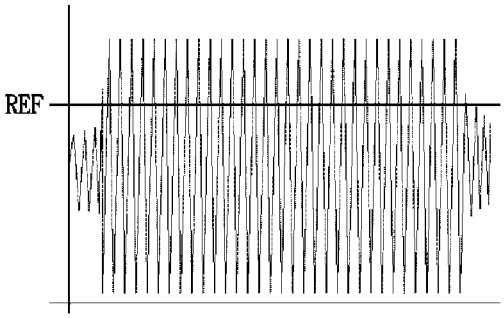
Figure 3C:
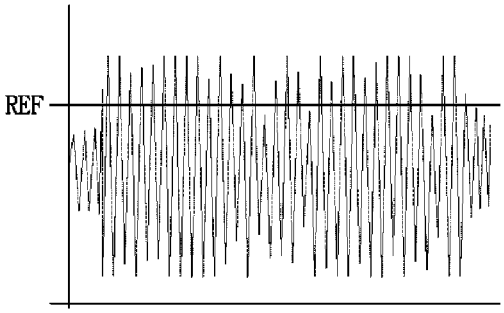
Figure 3D:
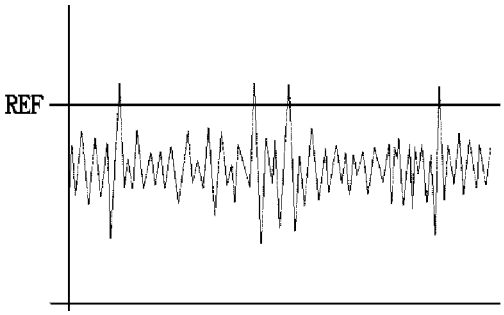

FIGS. 3A through 3D are diagrams showing waveforms of a signal received at the ultrasonic wave receiver according to the number of sheets of banknotes passing through a transfer path in an ultrasonic sensor in accordance with the present invention. First, if an ultrasonic signal is generated by the ultrasonic wave generator as shown in FIG. 3A, after a predetermined waiting time (a time for transferring an ultrasonic wave from the ultrasonic wave generator to the ultrasonic wave receiver) is elapsed, a detected signal is received by the ultrasonic wave receiver, as shown in FIGS. 3B through 3D.

At this point, when the number of sheets of banknotes passing through the transfer path is zero, a reflective wave reflected between the ultrasonic wave generator and the ultrasonic wave receiver as well as the ultrasonic signal generated by the ultrasonic wave generator and directly received by the ultrasonic wave receiver are introduced into the ultrasonic wave receiver again without being attenuated and is detected as a reception signal since there is no separate obstacle on the transfer path.

Accordingly, as for the waveform of the signal detected by the ultrasonic wave receiver, as shown in FIG. 3B, since the ultrasonic signal transmitted from the ultrasonic wave generator is introduced into the ultrasonic wave receiver with almost no change, a pulse waveform extremely similar to the transmitted pulse waveform is received with no change.

That is, when the number of sheets of banknotes is zero, the ultrasonic signal transmitted from the ultrasonic wave generator and then received at the ultrasonic wave receiver is not attenuated since any medium does not exist between the ultrasonic wave generator and the ultrasonic wave receiver. In addition, since the ultrasonic wave generator and the ultrasonic wave receiver are vertically arranged, the reflective wave is received by the ultrasonic wave receiver without being attenuated and maintains an intact waveform of the generated signal with almost no change.

On the other hand, when the number of sheets of banknotes passing through the transfer path is one, the ultrasonic signal transmitted from the ultrasonic wave generator and then attenuated while penetrating the banknote is received as a signal detected by the ultrasonic wave receiver. At this point, since the reflective wave reflected by the banknote passing through the transfer path before the ultrasonic signal arrives at the ultrasonic wave receiver is successively attenuated to leave only noise components due to the banknote passing through the transfer path in the reflection process between the ultrasonic wave generator and the ultrasonic wave receiver.

Accordingly, as shown in FIG. 3B, a signal waveform, into which a waveform of an ultrasonic signal attenuated by a predetermined level in the process of penetrating one sheet of banknote and a waveform of a noise signal are mixed, appears as a waveform of a signal detected by the ultrasonic wave receiver.

That is, as shown in FIG. 3C, although a waveform of the detected reception signal passing one sheet of banknote is shown uneven owing to the effect of the noise generated by the reflective wave, since the signal transmitted from the ultrasonic wave generator and then directly introduced into the ultrasonic wave receiver in a state of being attenuated while penetrating the one sheet of banknote is detected with a certain periodicity, a signal of at least a certain level or higher is repetitively detected with a periodicity.

In other words, although the magnitude of a signal value of the reception signal is attenuated by a predetermined level while the signal penetrates one sheet of banknote and the signal level is lowered, since the attenuated signal is repeated with a periodicity, a signal higher than a predetermined reference value is repetitively detected at predetermined time intervals (i.e., a half cycle of a generated signal pulse) as a waveform of the detected signal.

On the other hand, when the number of sheets of banknotes passing through the transfer path is two, since the ultrasonic wave transmitted from the ultrasonic wave generator is very severely attenuated while penetrating the two sheets of banknotes, a signal first arriving at the ultrasonic wave receiver, as well as the reflective wave, appear as a noise.

Accordingly, as shown in FIG. 3D, a waveform of a signal detected by the ultrasonic wave receiver also appears as a waveform of a noise signal with no periodicity.

As described above, since a waveform of a reception signal detected by the ultrasonic wave receiver appears in different shapes according to the number of sheets of banknotes passing through the transfer path, i.e., a zero sheet, a single sheet or double sheets, an ultrasonic signal detected by the ultrasonic sensor in accordance with the present invention may be used to detect the number of sheets of banknotes passing through the transfer path by detecting generation or not of the periodic signal and/or a frequency of the generation from the reception signal detected in this way.

Hereinafter, a method of detecting the number of sheets of banknotes passing through the transfer path using the above-described features of the present invention will be described in further detail through specific examples.

For example, assuming that an ultrasonic signal transmitted from the ultrasonic wave generator is 300 KHz, the period of the transmitted signal pulse is 3.3 μs, and the pulse width is 1.65 μs.

At this point, if a reference value REF is set through appropriate prior experiments considering the magnitude of a signal value attenuated when one sheet of banknote passes through the transfer path, most of signal values detected when one sheet of banknote passes through the transfer path show a peak value larger than the reference value (see FIG. 3C), and, accordingly, periodicity of the detected signal can be determined.

In more detail, first, when the number of sheets of banknotes passing through the transfer path is zero, as described above, a reception signal received at the ultrasonic wave receiver maintains a pulse waveform transmitted from the ultrasonic wave generator with almost no change. Accordingly, the number of times of counting a signal larger than the reference value is approximately 606 times (i.e., 100/1.65) in a period of 1 ms.

Accordingly, when a signal value received at the ultrasonic wave receiver is larger than a predetermined reference value (REF) is counted and the counted value is larger than a certain preset category value (e.g., 590 to 600 times) within a set detecting period (here, 1 ms), the number of the banknotes passing through the transfer path may be determined as zero.

In addition, when the number of sheets of banknotes passing through the transfer path is one, although the peak value may be lowered since the ultrasonic signal transmitted from the ultrasonic wave generator is attenuated in the process of penetrating one sheet of banknote, a signal higher than the predetermined reference value (REF) periodically appears in a detected reception signal since the signal attenuated while penetrating the one sheet of banknote is still directly received at the ultrasonic wave receiver at certain time intervals.

That is, in determining periodicity of a reception signal, a signal showing a value larger than the predetermined reference value (REF) is counted from detected signal values, and the reception signal may be determined as having a periodicity when the counted signal values are successively detected at time intervals of a half cycle of the generated signal.

For example, in the case of this embodiment, if a signal value counted to be larger than the reference value (REF) is repeatedly detected more than a predetermined number of times (e.g., 15 to 20 times) at time intervals of 1.6 μs to 1.7 μs, i.e., a half cycle of the generated signal pulse (1.65 μs), the reception signal is determined as having a periodicity, and, accordingly, the number of sheets of banknotes passing through the transfer path is determined as zero or one.

On the contrary, when the number of sheets of banknotes passing through the transfer path is two, most of the signal values detected at the ultrasonic wave receiver show a peak value smaller than the reference value (REF). Although a few signal values larger than the reference value (REF) are counted, the signal is determined as aperiodic since the time interval of the counted signal values is irregular. Accordingly, the number of sheets of banknotes may be determined as two.

That is, in the method of detecting double sheets using the ultrasonic sensor in accordance with the present invention, when the periodicity of a received signal is determined, if the signal is periodic, the number of sheets of banknotes is determined as zero or one, and if the signal is aperiodic, the number of sheets of banknotes is determined as two.

In addition, if the periodicity of the received signal is confirmed, whether the number of sheets of banknotes passing through the transfer path is zero or one is determined according to the frequency of generating periodicity of the received signal.

Figure 4:
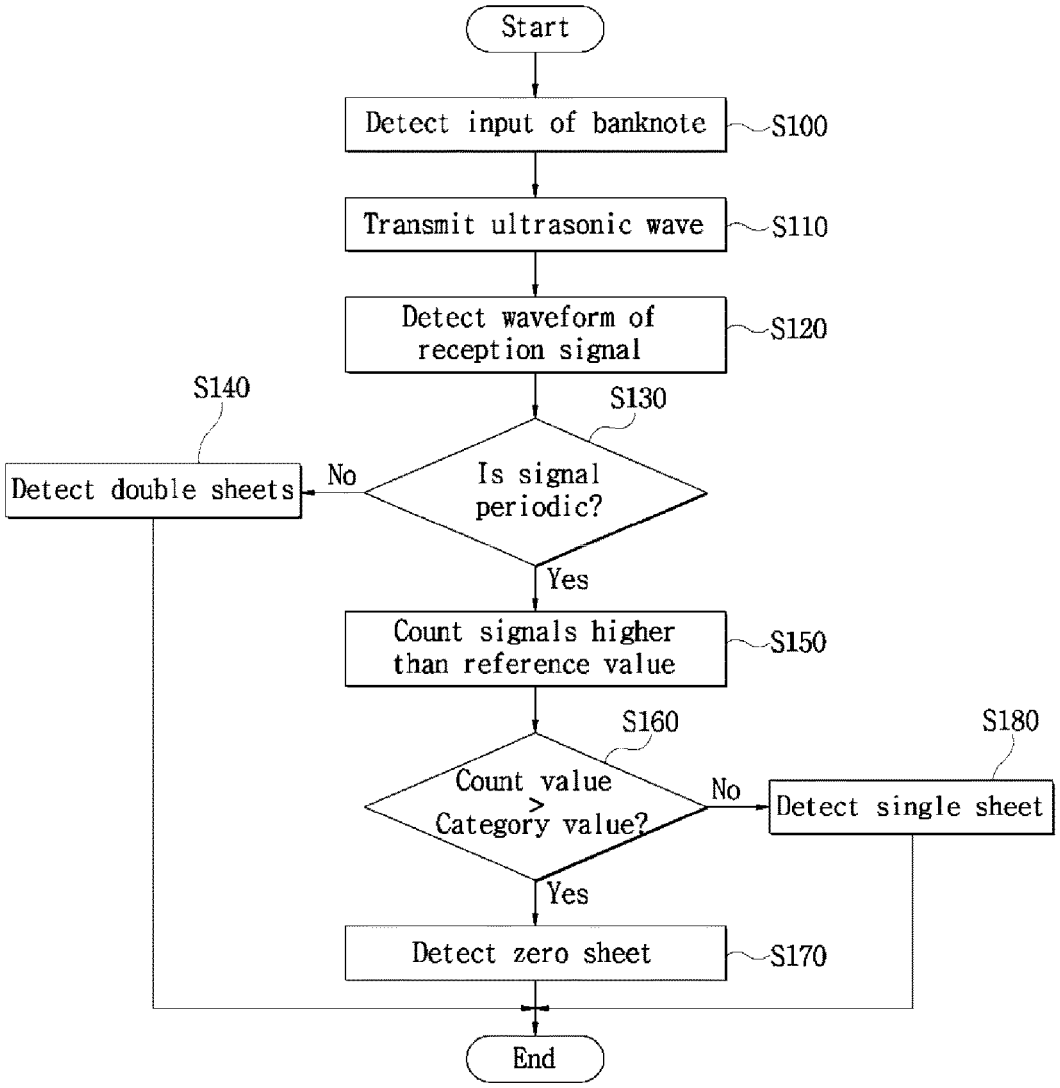
FIG. 4 is a flowchart illustrating a method of detecting double sheets using the ultrasonic sensor in accordance with one embodiment of the present invention.

FIG. 4 is a flowchart illustrating a method of detecting double sheets using the ultrasonic sensor in accordance with one embodiment of the present invention.

As shown in FIG. 4, if a banknote is detected to be input (step S100), an ultrasonic wave is transmitted from the ultrasonic wave generator (step S110), and a waveform of a signal received by the ultrasonic wave receiver is detected (step S120).

At this point, the periodicity is determined from the reception signal (step S130), and whether or not double sheets of the banknotes pass through the transfer path is determined according to generation or not of the periodic signal.

That is, when a signal value received at the ultrasonic wave receiver is larger than the predetermined reference value (REF) is detected and a signal value detected to be larger than the predetermined reference value (REF) is successively and repetitively detected more than a certain preset number of times within a range of a certain time interval preset according to properties of the sensor, the reception signal is determined as having a periodicity, and the number of sheets of banknotes passing through the transfer path is determined as zero or one.

On the contrary, although most of the signal values detected at the ultrasonic wave receiver are smaller than the reference value (REF) or some of the signal values are detected to be larger than the reference value (REF), if the detection time interval does not satisfy the conditions described above, the reception signal is determined as not having a periodicity, and the number of sheets of banknotes passing through the transfer path is determined as two (step S140).

At this point, if the reception signal is determined as having a periodicity, whether the number of sheets of banknotes passing through the transfer path is zero or one is determined according to the frequency of generating the periodic signal.

That is, when a signal value received at the ultrasonic wave receiver is larger than a predetermined reference value (REF) is counted (step S150) and the counted value is larger than a certain preset category value (step S160), the number of the banknotes passing through the transfer path is determined as zero (step S170).

On the contrary, when the counted value is smaller than the certain preset category value, the number of the banknotes passing through the transfer path is determined as one (step S180).

At this point, although whether there is a zero sheet or single sheet of the banknotes may be determined according to the frequency of generating the periodicity as described above, it may be determined by comparing a peak value of the received signal.

In other words, since when the number of sheets of banknotes passing through the transfer path is zero, a reception signal received at the ultrasonic wave receiver maintains a pulse waveform transmitted from the ultrasonic wave generator with almost no change, a peak value of the signal detected by the ultrasonic wave receiver is almost the same as a peak value of the signal generated at the ultrasonic wave generator. Thus, if a signal having a peak value larger than a preset peak reference value (e.g., a value corresponding to 95% of the peak value of the generated signal) is repeated a certain preset number of times (e.g., 10 to 20 times) in the signal detected by the ultrasonic wave receiver, the number of the banknotes passing through the transfer path may be determined as zero, or otherwise, it may be determined as one.

At this point, the peak reference value may be appropriately set within a range of 90 to 100% of the peak value of the generated signal.

As described above, in accordance with the ultrasonic sensor for detecting double sheets of the present invention and a method of detecting double sheets using the same, in configuring an ultrasonic sensor for detecting double sheets of banknotes passing through a transfer path, the ultrasonic sensor includes an ultrasonic wave generator and an ultrasonic wave receiver provided in pair to face each other in a direction perpendicular to a transfer direction of the banknotes with the transfer path for transferring the banknotes interposed therebetween, and periodicity of a reception signal detected by the ultrasonic wave receiver is determined to detect whether a zero sheet, a single sheet or double sheets of the banknotes pass through the transfer path according to generation or not of the periodic signal and/or a frequency of the generation. Thus, it is possible to enhance utilization of space of an automatic teller machine by reducing the volume of the apparatus through the vertical arrangement of the ultrasonic wave generator and the ultrasonic wave receiver.

In addition, in accordance with the present invention, it is possible to detect double sheets of banknotes further effectively by correctly detecting the number of sheets of banknotes and to enhance efficiency of processing the banknotes.

The present invention described above is not defined by the aforementioned embodiments and the accompanying drawings. Further, it will be understood by those skilled in the art that various replacements, changes and modifications can be made thereto without departing from the technical spirit and scope of the present invention.

What is claimed is:

1. A method of detecting transferring of overlapping sheets of banknotes, comprising:

transmitting an ultrasonic wave from an ultrasonic wave generator towards a transfer path of the sheets of banknotes;

receiving the emitted ultrasonic wave at an ultrasonic wave receiver paired with the ultrasonic wave generator to face the ultrasonic wave generator in a direction perpendicular to a transfer direction in which the banknotes are transferred via the transfer path;

generating a reception signal by the ultrasonic wave receiver responsive to receiving the emitted ultrasonic wave;

determining whether the reception signal is periodic or not, comprising;

determining that the reception signal is periodic when the number of times the reception signal exceeds a preset reference value in a preset detection time interval is larger than a certain preset number of times, and determining that the reception signal is not periodic when the number of times the reception signal exceeds the preset reference value is not larger than the certain preset number of times;

determining that two or more overlapped banknotes are being transferred responsive to the reception signal not being periodic; and determining that one or no banknote is being transferred responsive to the reception signal being periodic, wherein when the reception signal is determined to be periodic, determining that the number of the banknotes passing through the transfer path is zero responsive to the number of times the reception signal exceeding the preset reference value in the preset detection time interval is larger than a certain preset category value, and determining that the number of the banknotes passing through the transfer path is one responsive to the number of times the reception signal exceeding the preset reference value in the preset detection time interval is not larger than the certain preset category value.

2. A method of detecting transferring of overlapping sheets of banknotes, comprising:

transmitting an ultrasonic wave from an ultrasonic wave generator towards a transfer path of the sheets of banknotes;

receiving the emitted ultrasonic wave at an ultrasonic wave receiver paired with the ultrasonic wave generator to face the ultrasonic wave generator in a direction perpendicular to a transfer direction in which the banknotes are transferred via the transfer path;

generating a reception signal by the ultrasonic wave receiver responsive to receiving the emitted ultrasonic wave;

determining whether the reception signal is periodic or not, comprising determining that the reception signal is periodic when a number of times the reception signal exceeds a preset reference value in a preset detection time interval is larger than a certain preset number of times, and determining that the reception signal is not periodic when the number of times the reception signal exceeds the preset reference value is not larger than the certain preset number of times;

determining that two or more overlapped banknotes are being transferred responsive to the reception signal not being periodic; and determining that one or no banknote is being transferred responsive to the reception signal being periodic, wherein when the reception signal is determined to be periodic, determining that the number of the banknotes passing through the transfer path is zero responsive to a number of times magnitudes of peak values of the reception signal exceeding a preset peak reference value in the preset detection time interval is larger than a certain preset number of times, and otherwise determining that the number of the banknotes passing through the transfer path is one.

3. The method according to claim 2, wherein the peak reference value is 90 to 100% of a peak signal value of the signal generated in the ultrasonic wave generator.

* * * * *